United States Patent [19]

Lambert

[11] 4,032,011

[45] June 28, 1977

[54] PACKAGING ASBESTOS FIBERS

[75] Inventor: Gerard Lucien Lambert, Asbestos, Canada

[73] Assignee: Johns-Manville Corporation, Denver, Colo.

[22] Filed: Feb. 26, 1976

[21] Appl. No.: 661,576

Related U.S. Application Data

[62] Division of Ser. No. 438,969, Feb. 4, 1974.

[52] U.S. Cl. ..... 206/386; 206/497

[51] Int. Cl.² ..... B65D 19/00

[58] Field of Search ..... 206/386, 497

[56] References Cited

UNITED STATES PATENTS

| | | | |
|---|---|---|---|
| 3,670,880 | 6/1972 | Burleson et al. | 206/386 |
| 3,858,526 | 1/1975 | Lombard et al. | 206/386 |

*Primary Examiner*—George T. Hall

*Attorney, Agent, or Firm*—Robert M. Krone; Joseph J. Kelly; James W. McClain

[57] ABSTRACT

Disclosed is a method of packaging asbestos fibers wherein damp asbestos fibers are consolidated into blocks having a density of at least about 100 lbs./cu. ft. (PCF). These blocks can then be stacked on pallets, pulpable pallets if desired, and secured to said pallet with various means, for example with a shrink film, to produce a clean, compact package. At the point of use, the blocks are disintegrated using a block-breaker and the resultant pieces are then opened into a loose mass of asbestos fibers in a conventional opening apparatus.

2 Claims, 7 Drawing Figures

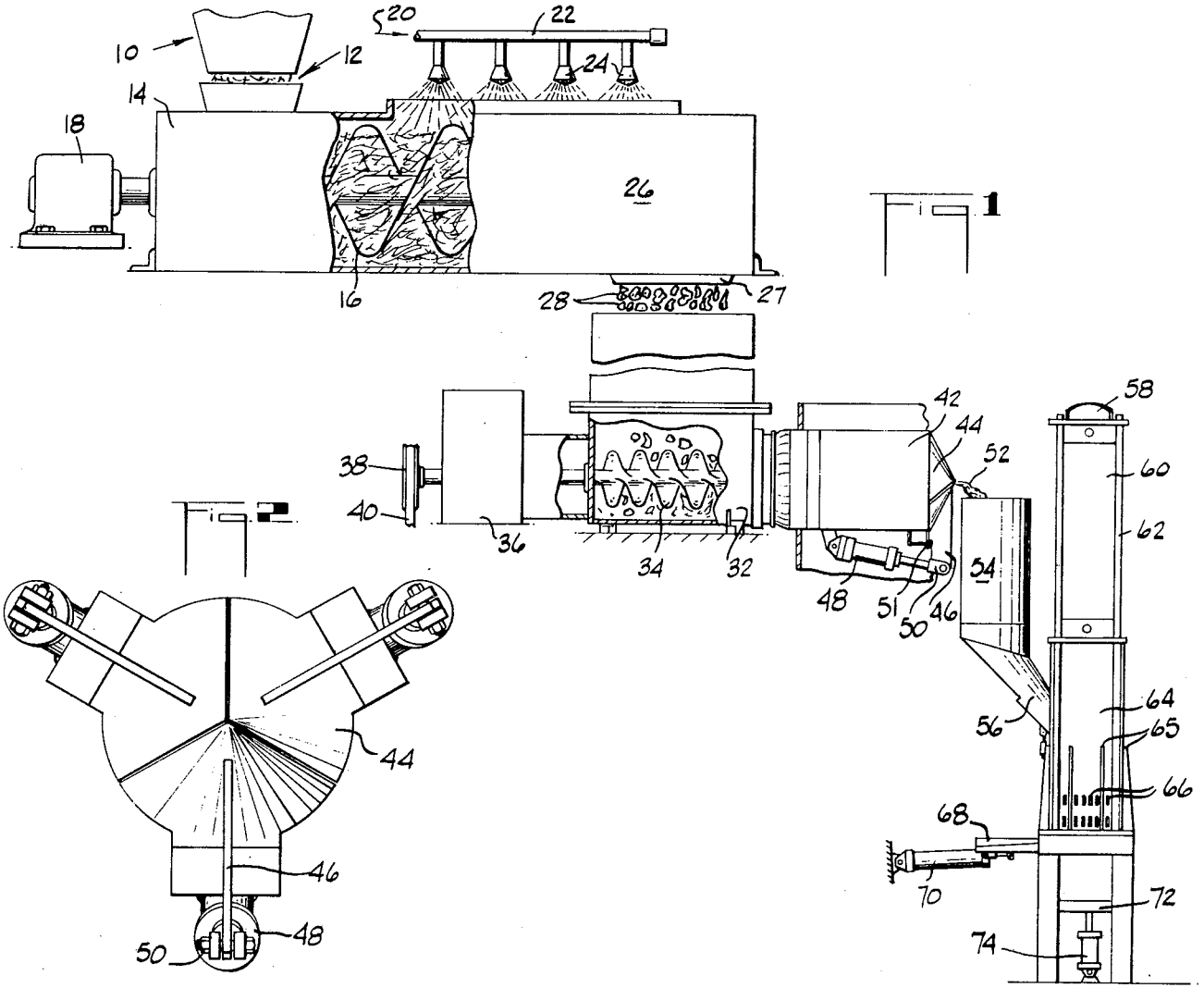
10
12
14
16
18
20
22
24
26
27
28
32
34
36
38
40
42
44
46
48
50
51
52
54
56
58
60
62
64
65
66
68
70
72
74
1
2

PACKAGING ASBESTOS FIBERS

This is a division of application Ser. No. 438,969, filed Feb. 4, 1974.

This invention relates to a novel asbestos package and to a process for packaging loose asbestos fiber for shipment. More particularly, it relates to packaging of asbestos fibers in an extremely dense and convenient form that insures less chance of damage and loss in shipment and thus more convenience and economy to the shipper, transporter and the user.

BACKGROUND OF THE INVENTION

Asbestos fiber, after it has been mined and separated from associated non-asbestos minerals and is ready for shipment, is in the form of a fluffy fibrous mass having a density of about 3 to about 20 PCF. Although asbestos can be shipped in this form either in containers or in bulk, in many cases it is desirable to ship the material in a densified form to reduce freight and handling costs.

In the past it has been customary to compact asbestos fiber in pressure-packed bags to a density of about 50 PCF. In this packaging technique the loose mass of asbestos fibers having a density of about 90 PCF and preferably at least 3 to 20 PCF and containing inherent moisture, which normally is less than about 1.5% is given a preliminary compaction to about 25 PCF using a screw conveyor or pug mill to partially de-air and compact the mass. The resultant 25 PCF material is then fed into a bag or a box under pressure to produce a package of asbestos fiber having a density of about 50 PCF. When these packages of asbestos reach the user, normally the asbestos is removed from the container and processed by a device which breaks the consolidated asbestos down into smaller pieces of a size convenient for further opening or dispersion in either wet or dry systems such as a pulper or fiber opener.

This conventional technique of packaging asbestos fiber has provided considerable savings and freight and handling costs are compared with the technique of shipping asbestos loose in low density form in containers such as bags, boxes, etc. The cost of bags or boxes for the 50 PCF technique shipment, however, is still significant. More importantly, a block density of about 50 PCF is still relatively low compared to the theoretical density of asbestos fiber which is about 159 PCF.

BRIEF SUMMARY OF THE INVENTION

It has now been discovered that if a liquid, such as water, is added and dispersed throughout the fluffy fibrous mass in a sufficient amount to raise the moisture content of the mass to about 2 to about 8% prior to the final compression step and if an intermediate compaction step is added, blocks having a density of at least about 100 PCF can be produced. These higher density blocks can be shipped without placing them in a container such as a bag or box. By stacking the blocks onto a pallet and securing said blocks thereon with conventional means, such as with a shrink film, the need for the bags or boxes previously used is eliminated.

BRIEF DESCRIPTION OF THE DRAWINGS

FIG. 1 is a side view of the equipment used to produce dense asbestos blocks for shipment.

FIG. 2 is an end view of a set of three movable sections used to restrict the flow of intermediately compacted damp asbestos fiber from the intermediate compaction apparatus.

DETAILED DESCRIPTION OF THE INVENTION

Figure 5:
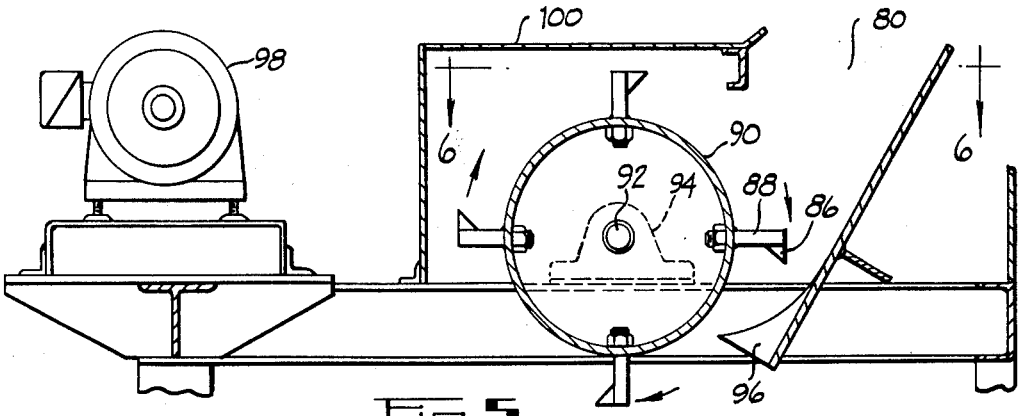
FIG. 5 is a side view of a block-breaker used to break up the block at the point of use as an initial step in reducing the block to a loose mass of asbestos fibers.

The system used to package asbestos fiber according to the present invention is illustrated in FIG. 1. Loose asbestos fiber 12 ready for packaging is continuously transferred from storage bin 10 into an auger-type mixer or pug mill 14. Auger 16, driven by drive means 18, rotates producing a mixing and consolidating action and at the same time causes the asbestos to move through the auger mixer.

Soon after the fluffy asbestos fiber enters mixer 14 it is subjected to a spray of liquid 20 from one or more nozzles 24 connected to a liquid source or manifold 22. The addition of a liquid to the asbestos fiber is critical to obtaining a density of at least about 100 PCF in the final compaction step. About 2 to 8%, based on the dry weight of the asbestos fiber, of liquid is added at this point. Water is the preferred liquid with an addition of about 2 to 8% being the most preferred range. Additions of 2–4% are typical, but additions above 4% are often necessary to achieve the desired density.

Other liquids, compatible with the user's requirements, could be used as well as small additions of wetting agents and/or plasticizers. For example, in cold weather it might be desirable to use a liquid having a very low freezing point such as a mixture of water and ethylene glycol.

The added liquid is evenly distributed in the fluffy mass of asbestos as the mixture is agitated and moved through the latter portion of the mixer 26. Some compaction or consolidation of the fibrous mass occurs in section 26 of the mixer 14 and therefore the mixer also functions as a preliminary compaction device. Finally, the damp asbestos is discharged from the mixer 14 as auger 16 moves it to opening 27.

Although a continuous auger mixer is illustrated for mixing and for providing preliminary compaction, other types of mixers, including batch-type mixers, could be used for this purpose. For example, continuous or batch-type paddle mixers and V-blenders (with agitators) could be used.

Preliminarily compacted damp asbestos fiber clumps 28 next enter intermediate compaction unit 32 which contains an extrusion auger 34 driven by a reducer 36 connected to a motor (not shown) by belt 40 and pulley 38. Auger 34 moves the damp asbestos clumps into the intermediate compaction chamber 42 where a set of three movable sections 44 restrict the opening in the end of the chamber. The movable sections provide sufficient back pressure on the damp asbestos to produce intermediately compacted asbestos fiber clumps 52 having a density of about 25 PCF.

Figure 3:
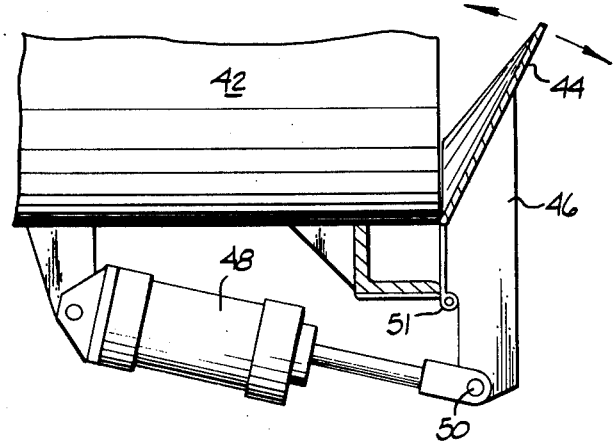
FIG. 3 is a side view of one of the three movable sections showing the section in a partially open position.

A hydraulic or pneumatic system is connected to cylinders 48 which are pivotally mounted to lever extensions 46 on movable sections 44 using a clevis and a pin 50 so that lever extension 46 can pivot around pin 51 (see FIG. 3) to adjust the size of the opening between the movable sections. Changing the position of the movable sections changes the size of the opening in the end of compaction chamber 42 (see FIG. 2) and thus adjusts the amount of back pressure asserted against the asbestos fiber in said chamber.

The amount of pressure required in the hydraulic or pneumatic system will vary depending upon the size of the cylinders 48, the diameter of chamber 42, the length of lever 46 and the location along lever 46 of pin 51. For example, in a system where chamber 42 has an internal diameter of about 8-13/16 inches, the cylinders for the movable sections are 1¾ inch bore, the lever arm distance between pin 50 and pin 51 is 2 inches and the lever arm distance between pin 51 and the inside diameter of chamber 42 is about 1⅝ inches, a hydraulic or pneumatic system pressure of about 20–80 PSI has been found to be a suitable operating range when auger 34 is rotating at about 100 RPM. The exact level of pressure necessary, however, will depend upon the grade and quality of asbestos and the amount and type of liquid present.

The intermediately compacted asbestos fiber clumps 52 are fed into hopper 54 which feeds a weigh-feeder 56 for feeding the desired weight of asbestos fiber into mold chamber 64 to make a block having a density of at least 100 PCF of a desired size. Any conventional weight-feeder can be used for this purpose.

The damp intermediately compacted asbestos fiber clumps are finally compacted into blocks with press 58. Any type of press normally used to consolidate loose materials would be suitable. The press illustrated in the drawings comprises a large hydraulic cylinder 60 mounted to the press with rods 62. The piston of cylinder 60 is connected to an upper platen that enters mold box 64, strengthened by ribs 65 and presses the damp asbestos therein against a stationary bottom platen 68.

Prior to final compaction, the intermediately compacted damp asbestos fiber clumps are relatively low in density and thus each charge of clumps in mold box 64 contains a substantial amount of air. Much of this air must be removed prior to or during compaction to allow the block to be pressed to at least 100 PCF density and to prevent build-up of air pressure within the compacted block during compaction that would crack the block when the exterior pressure on the block was reduced.

Figure 4:
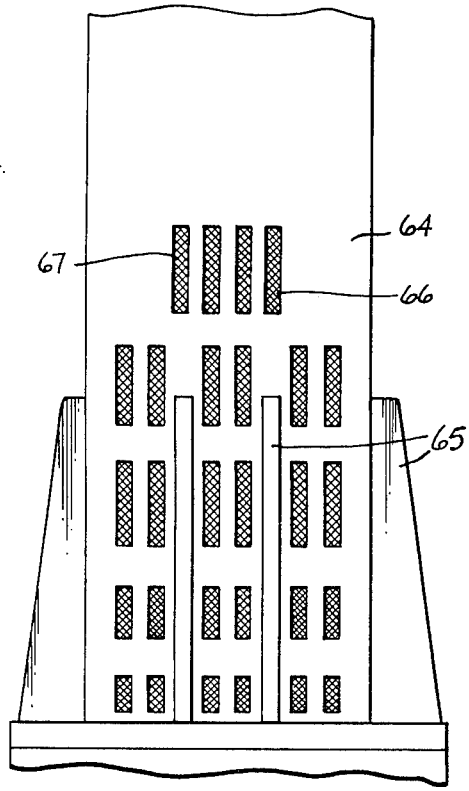
FIG. 4 is a side view of the mold box of the final compaction device or block press.

This undesirable air may be removed in several ways. For example, mold box 64 could be connected to a vacuum de-airing system which could be activated prior to and/or during pressing to remove the unwanted air. In the embodiment illustrated in FIGS. 1 and 4 the air is removed during pressing by forcing it out through a plurality of slots 66 located in the wall of mold box 64 by the pressing action. These slots are evenly distributed around the lower portion of mold box 64 where the final compression takes place. The slots should be sufficiently small to adequately support a permeable inner liner 67 (shown in FIG. 4) that prevents the asbestos fiber from escaping out through slots 66. A typical width for the slot is about 1 inch with the length varying between about 2½ to 6 inches.

Mold box 64 contains an inner permeable liner 67 covering the the slotted area. Suitable materials for use as said liner are metallic screens or perforated metallic thin sheet material having openings of about 1/16 of an inch or smaller. Since the purpose of the liner is to prevent the asbestos from being pressed out through slots 66, the size of the openings in the liner will vary somewhat depending upon the grade of asbestos fiber being compressed. The upper platen is sized to provide sufficient clearance to accomodate liner 67.

After the block has been finally compressed to the desired density, the pressure is released by reversing the upper platen with cylinder 60. The block receiving platen 72 is then raised into a position slightly below bottom platen 68, using cylinder 74. Bottom platen 68 is then withdrawn horizontally using cylinder 70 which allows the compressed block to drop onto block receiving platen 72. Block receiving platen 72 is then lowered with cylinder 74 to remove the block from mold box 64. The block is then removed from platen 72.

Figure 7:
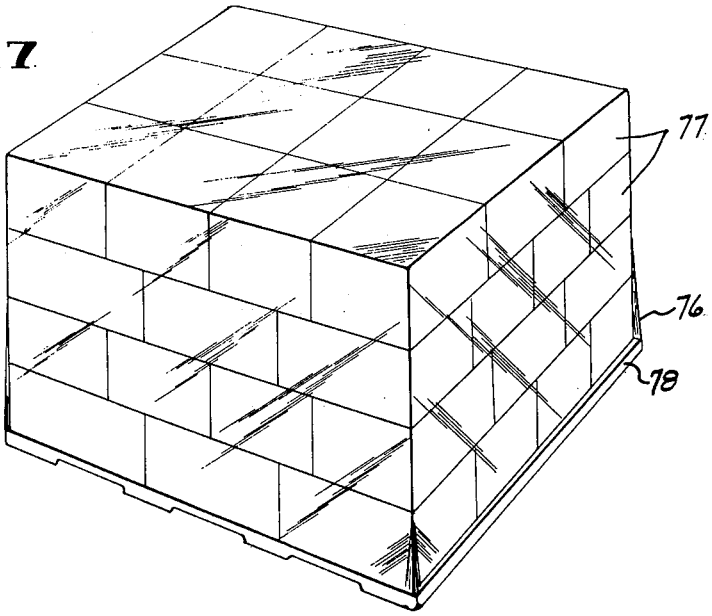
FIG. 7 is a perspective view of a plurality of the dense asbestos blocks fastened onto a pulpable pallet using a layer of shrink film.

Although the dense blocks could be placed in bags or boxes or other containers, this is not necessary. The dense blocks are relatively strong and relatively dust free. The most convenient and economical package is made by merely stacking and securing the blocks on a shipable pallet as shown in FIG. 7. Although any conventional securing means can be used, the most convenient and suitable technique is to place a heat shrinkable film such as polyethylene around the blocks and the pallet followed by heating which causes the film 76 to shrink and snugly secure the blocks 77 to one another and to pallet 78. Although any conventional pallet can be used for shipping the dense blocks, it is preferred to use a pulpable pallet, i.e. a pallet that can be broken down in the same manner as the blocks are broken down at the point of use to act as an ingredient in the resultant pulp. Pulpable pallets are well known and can be made of cardboard or from a pulpy fibrous mass in a similar manner to that used to make egg cartons. Asbestos fiber packaged in the manner shown in FIG. 7 can be shipped and stored in about one-half the space required by the former packaging techniques.

Figure 6:
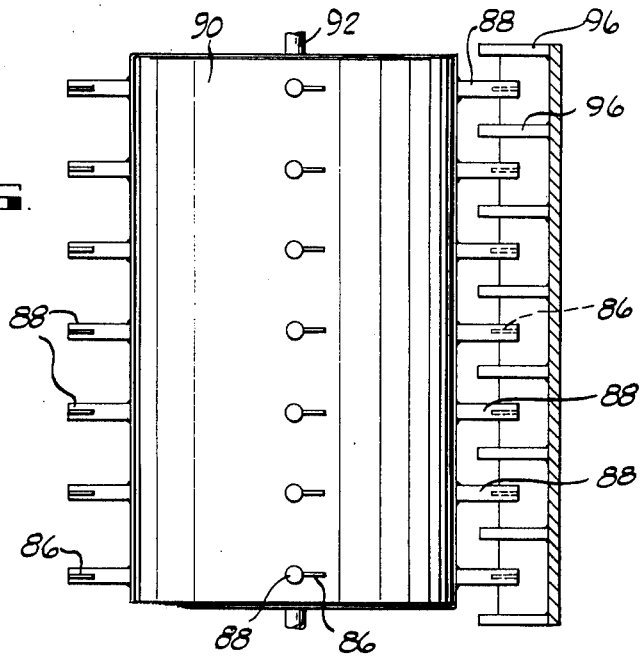
FIG. 6 is a partial top view of the block-breaker.

At the point of use, the shrink film 76 is removed from the package and the blocks 77 are fed into a block-breaker illustrated in FIGS. 5 and 6. Each block is fed into the opening 80 by placing the block on support 82 and letting the block slide down plate 82 in the opening 80. The block is contacted along its face by a plurality of rapidly moving chipping blades 86 mounted on a rotating drum 90 with pins 88. The drum 90 is mounted on an axle 92 supported by pillow block bearings 94 and is driven by a suitable conventional drive means (not shown) by motor 98. The drum can be any suitable length but preferably is only slightly longer than the longest dimension of the compressed asbestos block. The chipping blades are spaced along the drum at frequent intervals either in a plurality of rows as illustrated or in a random pattern. Although four rows of blades are preferred, more or less rows would also be suitable. The blades on any particular row can be staggered along the length of the drum with respect to the blades on an adjacent row or rows. This block-breaker device is similar to the apparatus used to break the 50 PCF asbestos fiber units shipped in bags or boxes. It is necessary, however, to strengthen the previously used disintegrater to make it compatible with the high density blocks of the present invention. This strengthening is accomplished merely by using heavier gauge material in the construction of the disintegrater particularly in the drum 90, blades 86, pins 88, and retaining means 96.

Although the intermediate compaction device illustrated in FIG. 1 is the preferred device for use in intermediately compacting the preliminarily compacted damp asbestos fiber clumps to about 25 PCF prior to final compaction in the block press, other devices could be used for intermediate compaction. For example, a device comprising a series of opposed rollers or a series of rollers opposing a moving flat surface could be used to compact the damp asbestos to a suitable intermediate density prior to final compaction.

What is claimed is:

1. An assemblage comprising a plurality of dense packages of asbestos fiber each comprising a compacted mass of asbestos fibers having a density of at least about 90 PCF, arranged on a pulpable pallet and secured thereto.

2. An assemblage as claimed in claim 1 wherein said plurality of packages are secured to said pulpable pallet with a shrink film.

* * * * *

UNITED STATES PATENT AND TRADEMARK OFFICE

CERTIFICATE OF CORRECTION

PATENT NO. : 4,032,011

DATED : June 28, 1977

INVENTOR(S) : Gerard Lucien Lambert

It is certified that error appears in the above-identified patent and that said Letters Patent are hereby corrected as shown below:

Column 1, line 41, "are" should read --as--.

Column 1, lines 25 and 26, delete "90 PCF and preferably at least".

Column 1, line 56, following "about" add --90 PCF and preferably at least--.

Column 3, line 30, "weight" should read --weigh--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*